US009873935B2

(12) United States Patent
Sanders et al.

(10) Patent No.: US 9,873,935 B2
(45) Date of Patent: Jan. 23, 2018

(54) METHOD FOR TREATING PLATE

(71) Applicant: GM GLOBAL TECHNOLOGY OPERATIONS LLC, Detroit, MI (US)

(72) Inventors: Ronald Sanders, Daxweiler (DE); Hartmut Baumgart, Ruesselsheim (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 235 days.

(21) Appl. No.: 14/727,131

(22) Filed: Jun. 1, 2015

(65) Prior Publication Data

US 2015/0345004 A1 Dec. 3, 2015

(30) Foreign Application Priority Data

May 31, 2014 (DE) ..... 10 2014 008 273
Jun. 28, 2014 (DE) ..... 10 2014 009 716

(51) Int. Cl.
*C23C 10/04* (2006.01)
*C23C 10/30* (2006.01)
*C23C 10/28* (2006.01)

(52) U.S. Cl.
CPC ..... *C23C 10/04* (2013.01); *C23C 10/28* (2013.01); *C23C 10/30* (2013.01)

(58) Field of Classification Search
CPC ..... C23C 10/04
See application file for complete search history.

(56) References Cited

U.S. PATENT DOCUMENTS 3,340,054 A 9/1967 Ward et al.
3,585,068 A * 6/1971 Holker ..... C25D 5/50 205/142
5,723,169 A * 3/1998 Han ..... H01J 9/142 313/402
2009/0206456 A1* 8/2009 Guth ..... H01L 23/3735 257/666

FOREIGN PATENT DOCUMENTS

DE 19650258 A1 6/1998
DE 19728855 A1 1/1999

OTHER PUBLICATIONS

Yu et al., "Silver nanoparticle-based thermal interface materials with ultra-low thermal resistance for power electronics applications," Scripta Materialia 66(11), pp. 931-934, Feb. 2012.*
German Patent Office, German Search Report for German Application No. 102014009716.1, dated Feb. 25, 2015.

* cited by examiner

*Primary Examiner* — Colin W. Slifka
(74) *Attorney, Agent, or Firm* — Lorenz & Kopf LLP

(57) ABSTRACT

A method for locally treating a plate is disclosed. A pattern formed from a compound containing at least one alloying element is applied onto at least one surface of the plate. At least the surface of a contacting layer including the pattern is covered by adequately heat-resistant material. The plate is subsequently heat treated in order to diffuse the alloying element into the plate.

20 Claims, 2 Drawing Sheets

METHOD FOR TREATING PLATE

CROSS-REFERENCE TO RELATED APPLICATIONS

This application claims priority to German Patent Application No. 102014008273.3, filed May 31, 2014 and German Patent Application No. 102014009716.1, filed Jun. 28, 2014, both of which are incorporated herein by reference in their entirety.

TECHNICAL FIELD

This application pertains to a method for forming plate parts having properties that are locally modified in regions.

BACKGROUND

Plate parts with locally modified properties can be created by locally alloying-in suitable alloying elements. DE 19650258 A1 describes a method for laser-alloying metal parts with alloying components being added in the form of rods or wires. This method is generally suitable for alloying linear regions but not for the uniform alloying of areal regions. In addition, the use of lasers is only economical for modifying minor area components of a plate or component, but not for larger area components.

SUMMARY

Accordingly, a method for the cost-effective treating of plates is provided in which at least a part region with a modified alloying composition is created in any desired location of the plate. According to a configuration of the present disclosure, a method for treating plate includes applying a pattern to at least one surface of the plate and heat-treating the plate in order to diffuse the alloying element into the plate. The pattern is formed from a compound containing at least one alloying element. The pattern on the heat-treated surface is covered by a contacting layer of material that is resistant to the heat treatment. Through the contacting layer, the plate surface is covered and during the heat treatment largely protected from undesirable reactions with the surrounding atmosphere so that elaborate methods for adjusting the atmosphere can be omitted. The simplest and most cost-effective way of providing the contacting layer is to likewise use a plate to be treated for this purpose.

During the heat treatment, the plate can be present in the form of a stack of plate parts of the same geometry. Accordingly, the surface of a plate to be treated can be completely covered by an adjacent plate as contacting layer. In order to minimize the width of a gap between the surface to be treated and the adjacent plate, the plate parts should be plate-shaped. In this way, they can lie flat on one another during the heat treatment.

Alternatively, the plate can be available as a coil during the heat treatment. Accordingly, an outer layer of the coiled plate in each case can form the contacting layer for the inner layer covered by it. Applying the pattern can be a printing-on of the compound, in particular screen printing. Screen printing is particularly suitable for plate-shaped plate parts.

Applying the pattern can be a spraying-on of the compound. This is practical in particular when working a coil since a spray nozzle that is immovable relative to the passing plate strip or only moveable transversely to the running direction of the plate strip can be used. The pattern can be applied on both surfaces of the plate. This can be affected by applying the compound onto the front and back side of the plate using the same method in each case such as for example printing on, spraying on or the like.

It is easier to apply the compound onto only a first surface of the plate and to apply the pattern onto the opposite second surface, by bringing this surface into contact with a pattern formed on the contacting layer. In the event that the compound is applied in the form of a paste or suspension which dries or sets on the contacting layer it can be practical to establish the contact with the second surface while the compound is not yet solid, so that they in fact enter into a close contact with the second surface and during the subsequent heat treatment the alloying element can diffuse into the plate and the contacting layer in equal parts.

The pattern can be congruently applied on both surfaces. If the alloying element is to be diffused in over the entire plate thickness, the heat treatment time can thereby shortened. Such congruent application can be realized in a simple manner in particular with stackable plate parts in that the compound in each case is applied onto a first surface of each plate part and subsequently the plate parts are congruently layered up into a stack so that the pattern through contact with the compound applied onto an adjacent plate part is applied onto the second surface. The compound can contain a powder of the at least one alloying element. The compound however can also contain a mixture of powders of multiple alloying elements or powder of an alloy.

Heat treatment can take place in a stationary oven, in particular a bell furnace. Especially with small batches or quantities this is more cost-effective than using continuous ovens. Heat treatment can take place in an inert gas atmosphere or in a vacuum. The use of inert gas or vacuum is practical in particular when the contact between the plate parts or the windings of the coil is not sufficient to ensure adequate protection of the surfaces of the plate layers located opposite one another against influences of the surrounding atmosphere or when at the edges of the plates or of the coil gaps which are open towards the outside are present between the plate layers.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
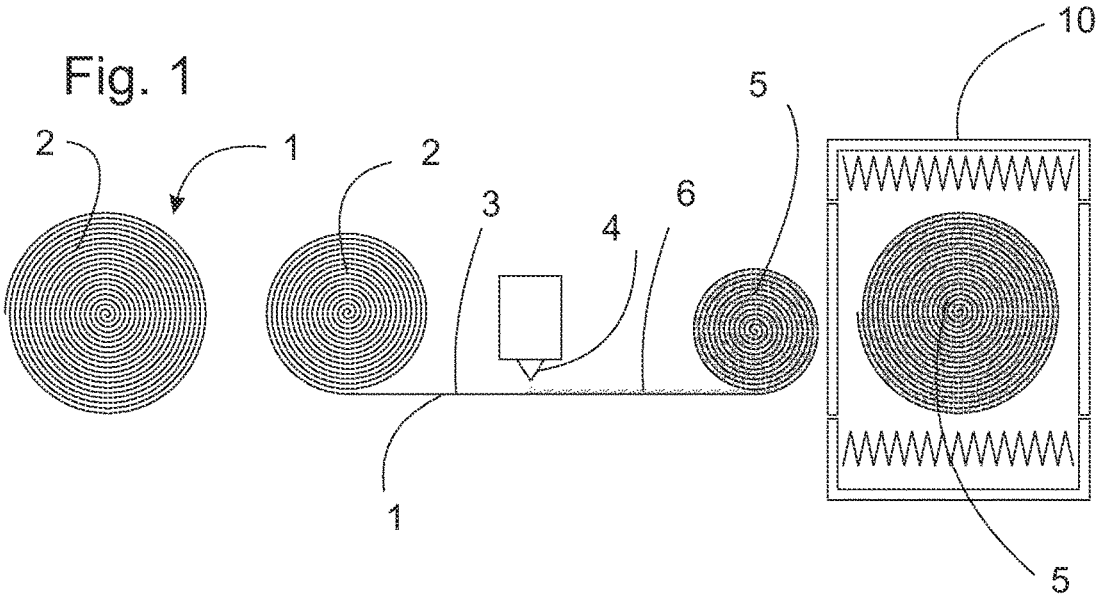
FIG. 1 illustrates a schematic sequence of the method for a first exemplary embodiment.

FIG. 1 schematically shows various stages of the method according to the present disclosure. In a first stage, shown in the left part of FIG. 1, the plate to be processed is present as a plate strip 1 wound into a coil 2.

The plate strip in this case consists of low-alloyed aluminum, preferably from an alloying group 1xxx, with a plate thickness of 0.5 to 3.5 mm. However, the method can also be applied to other plates, in particular low-alloyed steel sheets, preferably of an IF-steel and to other material thicknesses.

In its middle part, FIG. 1 shows the plate strip 1 that is partly unwound from the coil 2 and wound up into a new coil 5. Between the coils 2, 5 one or multiple spray nozzles 4 are arranged in order to apply a compound 6 to a first surface 3 (front side) of the strip 1 by spraying on, while said strip 1 is rewound from coil 2 onto coil 5. The spray nozzles 4 can be arranged fixed in location or be movable transversely to the running direction of the plate strip 1. The nozzles 4 are arranged in order to form on the surface 3 a pattern of regions that are covered by the compound 6 and such that are free of the compound 6.

The compound 6 contains at least one alloying element in the form of a powder which, in order to adhere to the surface 3 following the spraying, is suspended in liquid that is mixed with a binding agent if appropriate. If the plate strip 1 consists of aluminum, the alloying elements can be in particular copper and/or zinc. If it is a steel plate, carbon is also a consideration as alloying element.

The liquid can be volatile in order to at least largely evaporate before the freshly sprayed surface 3 reaches the coil 5 and further evaporation is prevented in that the compound is closed in between the already existing coil 5 and the surface 3. However, it can also be provided that the compound 6 for the major part still contains the liquid at the moment of its inclusion on the coil 5 so that it continues to be plastic and closely hugs the back side of the plate strip 1 which—when passing under the spray nozzles 4—is not coated with the compound 6. Once the entire plate strip 1 has been recoiled into the coil 5 and in the process has been provided with the compound 6, the coil 5 as shown in the right part of FIG. 1 is subjected to a heat treatment in a bell furnace 10.

According to an alternatively configuration, the spray nozzles are replaced by a roller on which the pattern to be applied is pre-molded. This pre-molding can consist in that the roller includes recesses in a manner known from intaglio printing, which receive the compound 6 coated onto the roller with the help of a doctor blade, while non-recessed surface regions of the roller do not receive the compound and in contact with the strip 1 transfer the compound 6 onto the surface 3 of the same. While the nozzles 4 are primarily suitable for applying patterns with elements that are elongated in running direction of the plate strip 1, patterns can also be created with the help of the roller which include elements that are elongated transversely to the running direction.

Figure 2:
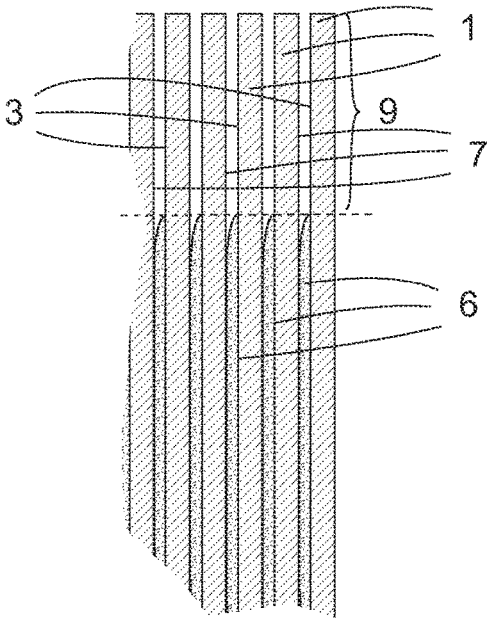
FIG. 2 illustrates a schematic extractive cross section through a coil.

In an extractive cross section through the coil 5, FIG. 2 shows the plate strip 1 with the applied compound 6. An edge region 9 on both edges of the plate strip 1 is clear of the compound 6. Between these two edge regions 9, the compound 6 can be applied in a manner covering the area. Although the compound 6 was initially sprayed on or rolled on only on the front side 3 of the plate 1, it is now also in close contact with its back side 7. In this way, the pattern is present on both surfaces 3, 7 of the strip 1.

This method is suitable above all for patterns formed of lines which extend in the direction of the longitudinal edges of the strip 1. By transferring such linear patterns onto the back side 7 of the plate, a congruent pattern is obtained on both plate surfaces 3, 7. Here, the pattern can also consist of multiple lines of any width. It must be noted here that when winding up the plate strip 1 into the coil 5 the contact of the applied compound 6 with the outside 7 has to be over as full an area as possible since the pattern is otherwise not uniformly transferred onto the outside 7.

During the heat treatment in the bell furnace 10, the coil 5 of aluminum plate provided with the compound 6 is heated up and held a temperature between 200° C. and 600° C. for 10 to 60 minutes in order to achieve diffusing in the alloying elements from the compound 6. In the case of a coil of steel plate, the temperatures must be selected higher, for example between 900° C. and 1100° C., ideally at 1050° C. During this diffusion annealing, temperature curve and time during the heating and holding are dependent on the dimensions of the coil 5 and the plate thickness. If possible these are adjusted so that a complete diffusion of the alloying elements from the compound 6 into the plate 1 is achieved.

Diffusion annealing can take place under air atmosphere. When the compound 6 or a sealing material applied in a manner similar to the compound 6 tightly seals intermediate spaces between windings of the plate strip 1 that are adjacent in the coil 5, reactions with the atmospheric oxygen remain restricted to the strip edges and in particular then have no effects on the parts produced from the annealed plate strip when on separating these parts any scaled or otherwise changed strip edges are cut away.

Figure 3:
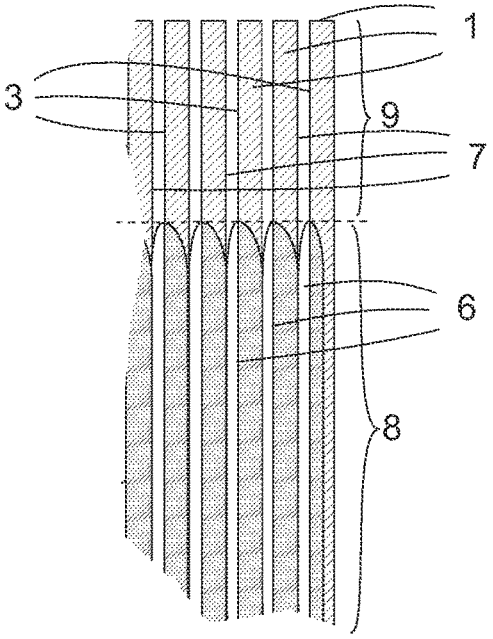
FIG. 3 shows the extract from FIG. 2 following diffusion annealing.

When, as in FIG. 2, along the edge regions 9 no compound 6 is applied and the properties of the edge regions 9 are to be adjusted in a defined manner, interfering reactions with oxygen can be avoided by using an inert gas atmosphere for example nitrogen. In individual cases, heat treatment in vacuum can also be practical. FIG. 3 shows the extract of FIG. 2 following the diffusion annealing. A concentration increase of the alloying elements relative to the initial state is obtained through the diffusion of the alloying elements from the applied compound 6 into the plate 1. Because of this a diffusion region 8 is created in the plate 1. Since the pattern was congruently applied on both surfaces of the strip 3, 7, the diffusion of both plate surfaces 3, 7 takes place simultaneously. In the present example, alloying up in the diffusion region 8 was achieved within the entire plate thickness. By subjecting both plate surfaces 3, 7 to diffusion, the diffusion time compared with one-sided diffusion is shortened. In addition, the alloy concentration can be symmetrically adjusted over the plate thickness.

On the outermost winding of the coil 5 the compound 6 is applied only on one side. In addition, it is not covered by contacting plate on one side. Consequently the properties of this winding differ from those of the windings located further inside. In practice, this outer winding is rejected during the further processing of the coil 5. The amount of the concentration and the distribution of the alloying elements in the plate determine the achievable strength and hardness increase. In the present example, an increase of strength and hardness in the diffusion region 8 is achieved while the edge regions 9 remain ductile.

In case that the bringing into contact of the still moist compound 6 on the front side 3 of the plate in the coil 5 with the back side 7 of the plate is not suitable in order to satisfactorily transfer the pattern on to the back side 7, the compound 6 can also be congruently applied onto both surfaces 3, 7 of the plate 1. This can be achieved by congruently spraying or rolling the pattern onto both surfaces 3, 7 of the plate 1 in step S1. Here it can be advantageous to dry the compound 6 before the plate 1 is wound up into the coil 5. Smudging the compound 6 or undesirable transferring of the pattern onto the contact surface 3 or 7 is thus avoided.

Figure 4:
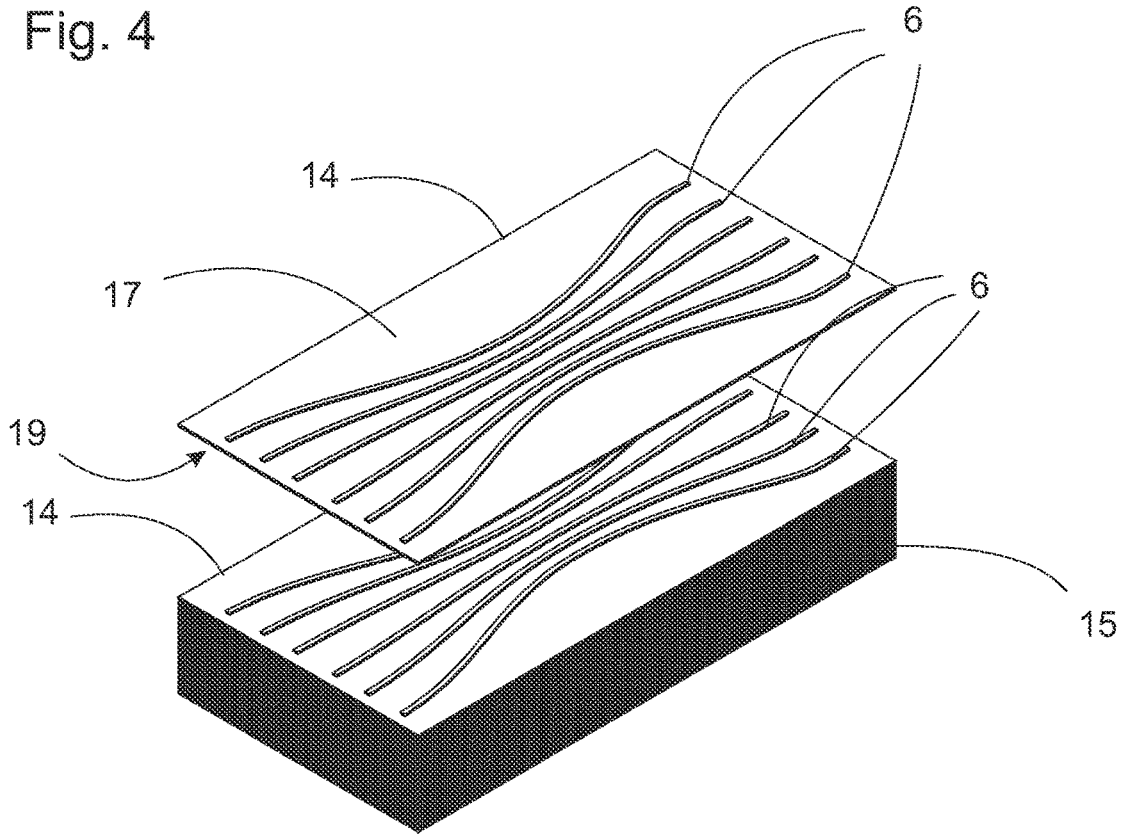
FIG. 4 illustrates a top view of a plate stack.

In a second exemplary embodiment, the plate 1 is present as a stack of plate-shaped, flat, unformed plate parts of steel plate. In the first step, the compound 6 is applied onto the plate parts in the form of a pattern. To this end, each plate part is individually placed into a screen printing machine and printed with the compound 6 on one side. In FIG. 4, one of the removed plate parts 14 is shown which is placed onto a stack 15 with the already printed plate parts 14. As in the first exemplary embodiment, the still moist compound 6 on the printed surface 17 comes into contact with the unprinted surface 19 (back side). Here it must be noted that the printed plate part 14 preferably has a good contact with the plate part of the stack 15 located below, lying on the same in a congruent manner. In a second step, the plate stack 15 is subjected to heat treatment in a bell furnace 10.

The pattern on the plate part 14 in the top view is evident in FIG. 4. It is formed of differently shaped lines consisting of compound 6. In this exemplary embodiment, no compound 6 is applied in a region along the edges of the plate parts 14. As shown, the pattern can be formed of lines, wherein the lines can also cross or form circles. The pattern can also be formed of areas shaped in any way. The edge region can also be covered by the pattern.

Figure 5:
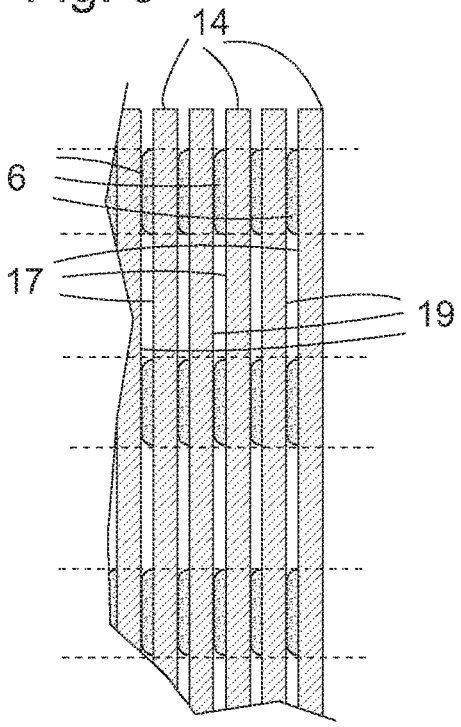
FIG. 5 illustrates a schematic extractive cross section through the plate stack.

In an extractive cross section through the plate stack 15, FIG. 5 shows the compound 6 applied onto the plate parts 14. As a consequence of the stacking, the unprinted back side of a plate 14 comes in contact with the still moist compound 6 on the printed front side 17 of another plate 14, so that the pattern is transferred to the unprinted back side 19. In this way, the pattern is congruently present on both surfaces 17, 19 of the plate parts.

In the second step, the plate stack 15 is subjected to heat treatment in the bell surface 10. In a first step of the heat treatment, the stack 15 is heated up and held at a temperature between 900° C. and 1100° C. for 15 to 60 minutes in order to achieve the carbon from the compound 6 diffusing into the steel plate parts 14. During this diffusion annealing, temperature curve and time during the heating-up and holding are dependent on the dimensions of the stack 15 and of the plate thickness. These are preferentially adjusted so that complete diffusion of the alloying elements from the compound 6 into the plate parts 14 is achieved.

Following this, the plate stack 15 is quenched from the temperature of the diffusion annealing in the known manner. The choice of the quenching medium and of the quenching conditions depends on the steel material and the properties to be achieved.

In a second stage of the heat treatment, the stack 15 is subjected to a tempering treatment in the bell furnace 10. The tempering conditions depend in the known manner from the steel material and the properties to be achieved. Temperature curve and time during the heating-up and holding are dependent on the dimensions of the stack 15 and on the plate thickness.

Diffusion annealing and tempering treatment can take place under air atmosphere. Reactions with the atmospheric oxygen occur in particular along the edges of the plate parts 14 as explained above. If the properties of the edges resulting from this are unimportant since the edges are for example trimmed later on, air atmosphere can be utilized. If, as in FIG. 5, along the edge no compound 6 is applied and the properties of the edges are to be adjusted in a defined manner, interfering reactions with oxygen can be avoided by using an inert gas atmosphere, for example nitrogen. In individual cases, heat treatment in vacuum can also be practical.

Figure 6:
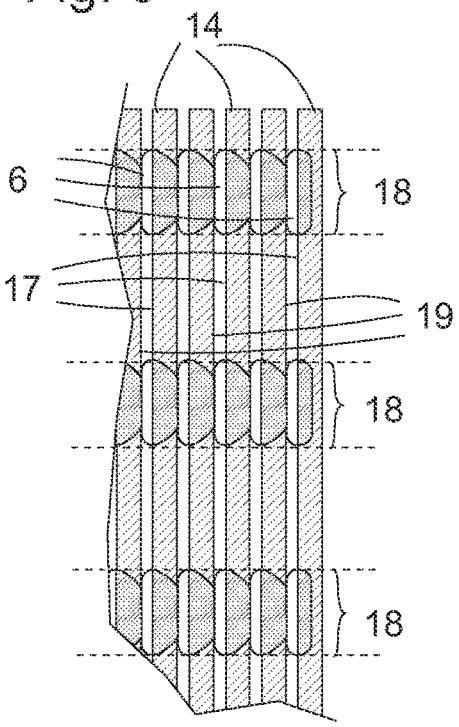
FIG. 6 shows the extract from FIG. 5 following diffusion annealing.

FIG. 6 shows the extract from FIG. 5 following diffusion annealing. An increase in concentration of the alloying elements relative to the initial state is obtained through the diffusion of the alloying elements from the applied compound 6 into the plate 14. Because of this, a diffusion region 18 is created in the plate 14. Since the pattern was congruently applied onto both surfaces 17, 19 of the plate parts, both plate surfaces 17, 19 are simultaneously subjected to diffusion. In the present example, alloying up was achieved in the diffusion region 18 within the entire plate thickness. By subjecting both plate surfaces 17, 19 to diffusion, the diffusion time relative to one-sided diffusion is shortened. In addition, the alloy concentration can be symmetrically adjusted over the plate thickness.

While at least one exemplary embodiment has been presented in the foregoing detailed description, it should be appreciated that a vast number of variations exist. For example, neither both exemplary embodiment is restricted to the stated materials and alloying elements. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the present disclosure as set forth in the appended claims and their legal equivalents.

What is claimed is:

1. A method for treating a plate comprising:

applying a pattern onto a major face of a first plate, wherein the pattern comprises a compound containing at least one alloying element;

covering at least a portion of the major face having the pattern with a contacting layer of material that is resistant to a heat treatment;

subsequently heat treating of the first plate to diffuse the alloying element into a diffusion region therein; and diffusing the alloying element so that the diffusion region extends completely through the first plate.

2. The method for treating a plate according to claim 1, wherein the contacting layer comprises a second plate to be treated.

3. The method for treating a plate according to claim 2, wherein the second plate is present during the heat treatment in the form of a stack of plate parts of the same geometry as the first.

4. The method for treating a plate according to claim 3, wherein the plate parts are plate-shaped and during the heat treatment lie flat on one another.

5. The method for treating a plate according to claim 1, wherein heat treating of the first plate comprises heat treating the first plate while the first plate is in the form of a coil.

6. The method for treating a plate according to claim 1, wherein applying the pattern comprises printing the compound onto the major face of the first plate.

7. The method for treating a plate according to claim 6, wherein applying the pattern comprises intaglio printing the compound onto the major face of the first plate.

8. The method for treating a plate according to claim 6, wherein applying the pattern comprises screen printing the compound onto the major face of the first plate.

9. The method for treating a plate according claim 1, wherein applying the pattern comprises spraying the compound onto the major face of the first plate.

10. The method for treating a plate according claim 1, wherein the pattern is applied onto both the first major face and a second major face of the first plate.

11. The method for treating a plate according to claim 10, further comprising bringing the second major face into contact with the pattern formed on the contacting layer.

12. The method for treating a plate according claim 10, wherein the pattern is congruently applied onto both the first and second major faces.

13. The method for treating a plate according claim 1, wherein the compound contains a powder of the at least one alloying element.

14. The method for treating a plate according to claim 1, further comprising heat treating the first plate in a stationary oven.

15. The method for treating a plate according to claim 1, further comprising heat treating the first plate in a bell oven.

16. The method for treating a plate according to claim 1, further comprising heat treating the first plate in an inert gas atmosphere or in vacuum.

17. The method for treating a plate according to claim 1, further comprising heat treating the first plate in a vacuum.

18. A method for treating a plate that has edges comprising:

applying a pattern onto a major face of a first plate, wherein the pattern comprises a compound containing at least one alloying element;

leaving a region along each of the edges free of the compound;

covering at least a portion of the major face having the pattern with a contacting layer of material that is resistant to a heat treatment;

heat treating the first plate to diffuse the alloying element therein; and maintaining a region along each of the edges with no diffusion of the alloying element.

19. The method for treating a plate according to claim 18, further comprising reacting the edges with atmospheric oxygen.

20. A method for treating a plate comprising:

applying a pattern onto a major face of a first plate, wherein the pattern comprises a compound containing at least one alloying element;

covering at least a portion of the major face having the pattern with a contacting layer of material that is resistant to a heat treatment;

heat treating the first plate to diffuse the alloying element therein; and holding a temperature of the heat treating for 10 to 60 minutes to achieve diffusion of the alloying element from the compound into the first plate, wherein the temperature is between 200° C. and 600° C.

* * * * *